United States Patent [19]

Genetay et al.

[11] Patent Number: 4,524,500

[45] Date of Patent: Jun. 25, 1985

[54] PROCESS FOR CONVERTING A CERAMIC TOILET COMMODE INTENDED TO BE SUPPLIED WITH AN INDEPENDENT WATER SUPPLY PIPE INTO A TOILET COMMODE ADAPTED TO BE SUPPLIED WITH WATER BY AN ASSOCIATED TANK

[75] Inventors: Michel Genetay; Gérard Dangers, both of Selles-sur-Cher, France

[73] Assignee: Societe Anonyme des Produits Ceramiques de Touraine, Selles-sur-Cher, France

[21] Appl. No.: 476,375

[22] Filed: Mar. 17, 1983

[30] Foreign Application Priority Data

Mar. 24, 1982 [FR] France ..... 82 04994

[51] Int. Cl.[3] ..... B21D 53/00; B21K 29/00; B23P 15/26

[52] U.S. Cl. ..... 29/157 R; 29/401.1; 29/428; 4/300; 4/420; 138/178

[58] Field of Search ..... 29/401.1, 428, 157 R; 4/300, 420, 661; 138/178

[56] References Cited

U.S. PATENT DOCUMENTS

| | | | |
|---|---|---|---|
| 799,418 | 9/1905 | Thompson et al. | 4/300 |
| 1,281,457 | 10/1918 | Whitney et al. | 4/300 |
| 1,446,773 | 2/1923 | Sweeney | 4/300 |
| 1,575,617 | 3/1926 | Bulley | 138/178 UX |
| 2,449,754 | 9/1948 | Seitz | 138/178 UX |
| 2,761,149 | 9/1956 | Kay | 4/300 X |
| 2,866,981 | 1/1959 | McMinn | 138/178 X |
| 3,500,480 | 3/1970 | Michal, Jr. | 138/178 X |
| 3,500,531 | 3/1970 | Wright | 29/401.1 |
| 3,905,052 | 9/1975 | De Angelis | 4/420 X |
| 4,277,854 | 7/1981 | Tsai | 4/420 |

FOREIGN PATENT DOCUMENTS

| | | |
|---|---|---|
| 2093348 | 1/1972 | France . |
| 2470824 | 6/1981 | France . |
| 531085 | 12/1940 | United Kingdom . |

*Primary Examiner*—Charlie T. Moon

*Attorney, Agent, or Firm*—Wenderoth, Lind & Ponack

[57] ABSTRACT

A ceramic toilet commode intended to be supplied with water by an independent water supply pipe and including a cylindrical rear receiving cavity for the water supply pipe and a horizontal platform in vertical alignment with the rear of the receiving cavity is converted into a toilet commode intended to be supplied with water by an adjoining cistern. This is achieved by boring in the platform a central aperture whose diameter exceeds the diameter of the cavity. Inserted in the aperture is an elbow element which has at one end a flange which bears against the edges of the aperture. The elbow element has a diameter which decreases to the other end thereof so as to permit the insertion of this other end into the receiving cavity.

6 Claims, 4 Drawing Figures

PROCESS FOR CONVERTING A CERAMIC TOILET COMMODE INTENDED TO BE SUPPLIED WITH AN INDEPENDENT WATER SUPPLY PIPE INTO A TOILET COMMODE ADAPTED TO BE SUPPLIED WITH WATER BY AN ASSOCIATED TANK

BACKGROUND OF THE INVENTION

The present invention relates to the conversion of a ceramic toilet commode or bowl intended to be supplied with water by an independent water supply pipe into a commode or bowl supplied with water by a tank adjoining thereto.

In the present state of the art, water is supplied to a toilet commode in two different ways:

- the reserve supply of water may be located in a container fixed to the toilet commode, a valve mechanism permitting the release of the content of the tank into the commode which can then operate and discharge the waste matter;
- the reserve supply of water may be separate from the toilet commode; for example it may concern a cistern under pressure connected to the sanitary water supply circuit, a cistern hidden in a partition wall or located very high up and fixed to the partition wall in which case the connection to the commode is by way of a pipe provided with a sealing element entering a receiving cavity specially provided in the ceramic.

The existence of these two types of water supply and the existence of two discharge systems (vertical or horizontal) therefore require for a given design the construction of four toilet commode models so as to satisfy the different requirements of the market.

The existence of these four models requires that the ceramic manufacturer organize the manufacture of moulds and parts for the four models, direct and organize the enamelling and the stocks of finished products for the four models.

Bearing in mind the volumes of sanitary ceramic products, it is of particular interest and profitable to eliminate a model in stock.

Further, the time required for developing a model of a ceramic lavatory commode is very long and expensive.

SUMMARY OF THE INVENTION

An object of the invention is to limit the number of models by permitting the conversion of a model supplied with water independently into a model which is capable of receiving an adjoining water tank.

The invention therefore provides a process for converting a ceramic toilet commode intended to be supplied with water by way of an independent water supply pipe and comprising a cylindrical rear receiving cavity for the water supply pipe and a horizontal platform vertically above the rear of the receiving cavity, into a toilet commode intended to be supplied with water by an adjoining tank, wherein there is bored in said platform a central aperture whose diameter exceeds the diameter of said cavity and there is inserted in the aperture obtained by said boring an elbow element which has at one of its ends a flange which is applied against the edges of said aperture and whose diameter decreases toward the other end so as to permit the insertion of said end in said receiving cavity.

The elbow element inserted in the aperture obtained by the boring operation advantageously has a diameter which varies continuously. The diameter of this elbow element in the vicinity of the flange is usually slightly less than the diameter of the bored aperture so as to permit the insertion of an elastic elastically yieldable locking sealing element. Likewise, the diameter of the other end of the elbow element is advantageously slightly less than the diameter of the receiving cavity of the commode so as to permit the insertion of another elastically yieldable locking sealing element.

BRIEF DESCRIPTION OF THE DRAWINGS

The invention is described hereinafter in more detail with reference to the drawings, which illustrate one manner of carrying out the process of the invention.

In the drawings.

DETAILED DESCRIPTION OF THE INVENTION

Figure 1:
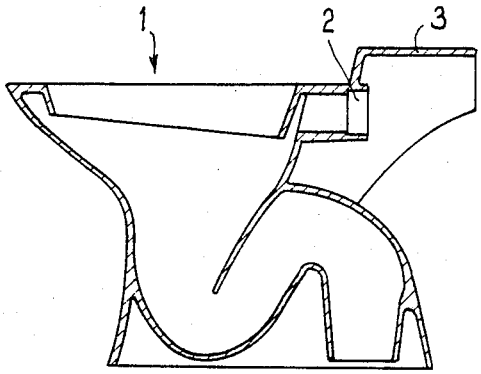
FIG. 1 shows a toilet commode adapted to be supplied with water by an independent water supply pipe before conversion of the commode.

The toilet commode shown in FIG. 1 is a conventional commode or bowl adapted to be supplied with water by an independent water supply pipe. It is of the type in which the water is discharged downwardly. This commode 1 comprises in its rear part of a cylindrical receiving cavity 2 having a substantially horizontal axis for receiving the water supply pipe.

The commode 1 further comprises, in the rear part thereof, a horizontal platform or shelf 3 which is in vertical alignment with the rear of the pipe-receiving cavity 2.

Figure 2:
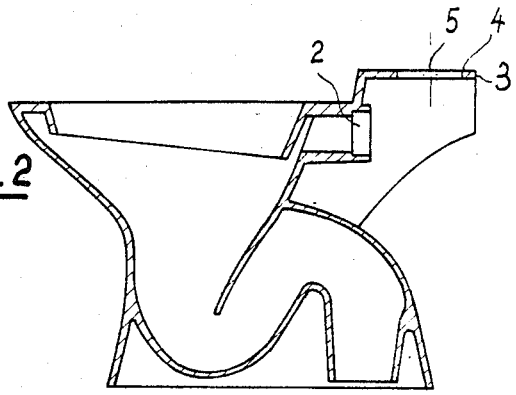
FIG. 2 shows the commode of FIG. 1 after an aperture has been bored therein.
Figure 4:
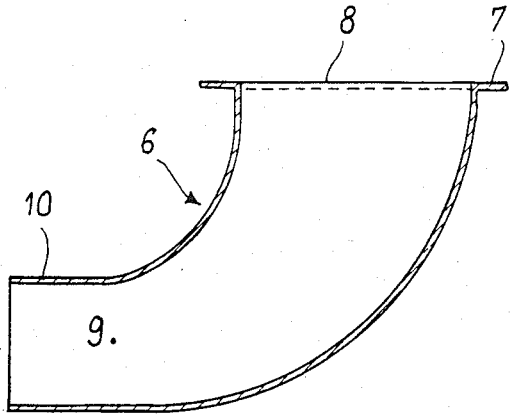
FIG. 4 shows, to an enlarged scale, an elbow element employed in carrying out the present invention.

This commode is converted in the following manner:

As shown in FIG. 2, there is first bored in the platform 3 a central aperture which has a diameter which is for example about twice the diameter of the cavity 2. In this way, there is obtained a cylindrical aperture 4 having a vertical axis. Bored on each side of this cylindrical aperture 4 are two other apertures 5 of small diameter such as for the passage of fixing screws. These apertures may be produced on the baked ceramic material by means of conventional diamond-carrying boring tools. However, note that these apertures may be produced in a previous stage in the course of manufacture, for example during the mould stripping cycle. There is then inserted in the cylindrical aperture 4 an elbow element shown in FIG. 4. This elbow element 6 may be made for example from a plastics material. It comprises in its upper part a flange 7 surrounding its upper aperture 8. Its diameter continuously diminishes in the direction of its lower end 9 which is terminated by a cylindrical portion 10. The axis of this cylindrical end portion 10 is orthogonal to the axis of the upper aperture 8.

Figure 3:
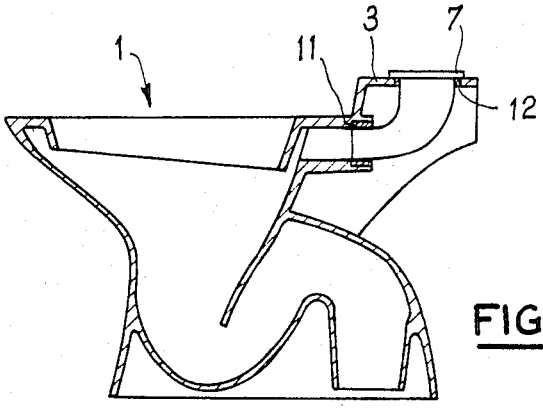
FIG. 3 shows the same commode after conversion thereof for receiving an adjoining cistern.

The elbow element 6 is inserted in the commode shown in FIG. 2 in the manner shown in FIG. 3. The elbow element 6 is inserted by its lower end 9 by passing it through the cylindrical aperture 4 and into the cylindrical receiving cavity 2. An elastically yieldable sealing element 11 was previously disposed in this receiving cavity and the end portion of the cylindrical part 10 of the elbow element 6 is inserted in this element 11. There was also previously mounted an elastically yieldable sealing element 12 in the cylindrical aperture 4 so as to provide a joint between this cylindrical aperture and the upper end portion of the elbow element 6. The shape of the elbow element 6 is so designed that the flange 7 bears against the horizontal platform 3 when the eblow element is in position.

The commode shown in FIG. 3 may then receive in the conventional manner an adjoining cistern or tank which bears against the platform 3 and is fixed to the latter by screws extending through the apertures 5.

Thus it is possible to convert easily a toilet commode adapted to be supplied with water by an independent water supply pipe into a toilet commode adapted to receive an adjoining cistern. This permits in particular a reduction in the stock of products both during manufacture and when the products leave the factory.

Having now described our invention what we claim as new and desire to secure by Letters Patent is:

1. A process for converting a ceramic toilet commode intended to be supplied with water by way of an independent water supply pipe and comprising a rear cylindrical receiving cavity for the water supply pipe and a horizontal platform vertically above the rear of the receiving cavity, into a toilet commode intended to be supplied with water by an adjoining cistern, said process comprising:

boring in said platform a central aperture having a diameter exceeding the diameter of said cavity;

inserting into said bored aperture an elbow pipe element which has adjacent to one of its ends a flange applied against the edge of said aperture and which has a diameter decreasing in a direction toward the other end of said elbow pipe element; and inserting said smaller other end of said elbow pipe into said receiving cavity of said toilet commode.

2. A process according to claim 1, wherein said elbow pipe element has a diameter which varies continuously.

3. A process according to claim 1, comprising disposing a sealing element in said bored aperture for securing the end of said elbow pipe element adjacent to said flange.

4. A process according to claim 1, comprising disposing a sealing element in said receiving cavity for securing said other end of said elbow pipe element of smaller diameter.

5. A process according to claim 3, comprising disposing a sealing element in said receiving cavity for securing said other end of said elbow pipe element of smaller diameter.

6. A process according to claim 1, further comprising boring in said platform two apertures on each side of said central aperture for the passage of screws for fixing an adjoining cistern.

* * * * *